US008454122B2

(12) United States Patent
Kubo

(10) Patent No.: US 8,454,122 B2
(45) Date of Patent: Jun. 4, 2013

(54) IMAGE FORMING APPARATUS

(75) Inventor: Isamu Kubo, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 381 days.

(21) Appl. No.: 12/503,183

(22) Filed: Jul. 15, 2009

(65) Prior Publication Data

US 2010/0020128 A1 Jan. 28, 2010

(30) Foreign Application Priority Data

Jul. 28, 2008 (JP) ..... 2008-193088

(51) Int. Cl.
*B41J 2/165* (2006.01)

(52) U.S. Cl.
USPC ..... 347/36

(58) Field of Classification Search
None
See application file for complete search history.

(56) References Cited

U.S. PATENT DOCUMENTS

| | | | | |
|---|---|---|---|---|
| 2003/0067505 | A1* | 4/2003 | Kumagai | 347/35 |
| 2006/0181569 | A1* | 8/2006 | Kawashima et al. | 347/36 |
| 2007/0013735 | A1* | 1/2007 | Sakakitani | 347/36 |
| 2008/0106572 | A1* | 5/2008 | Yoshino et al. | 347/36 |
| 2008/0204505 | A1 | 8/2008 | Kubo | |
| 2008/0218564 | A1 | 9/2008 | Kubo | |

FOREIGN PATENT DOCUMENTS

| | | |
|---|---|---|
| JP | 2005-254636 | 9/2005 |
| JP | 2007-50565 | 3/2007 |
| JP | 2007-125825 | 5/2007 |
| JP | 2007-130998 | 5/2007 |

* cited by examiner

*Primary Examiner* — Matthew Luu
*Assistant Examiner* — Alejandro Valencia
(74) *Attorney, Agent, or Firm* — Cooper & Dunham LLP

(57) ABSTRACT

An image forming apparatus includes a recording head configured to jet droplets of recording liquid; a maintenance device configured to maintain/restore a condition of the recording head, whereby the maintenance device is detachably attached to a body of the image forming apparatus; and a waste liquid tank configured to hold waste liquid collected by the maintenance device, whereby the waste liquid tank is disposed adjacent to the maintenance device. The maintenance device has a jetting tube configured to discharge the waste liquid into the waste liquid tank. The waste liquid tank includes an induction opening surrounding the jetting tube, whereby the induction opening has a notch through which the jetting tube passes when the maintenance device is detached from the body. The image forming apparatus further includes a wall member configured to block at least part of the notch when the maintenance device is attached in the body.

12 Claims, 14 Drawing Sheets

IMAGE FORMING APPARATUS

BACKGROUND

1. Technical Field

The disclosure relates to an image forming apparatus, and more particularly to an image forming apparatus including a recording head for jetting liquid droplets of recording liquid; a maintenance device that is detachably attached to the apparatus, which is for maintaining/restoring the condition of the recording head; and a waste liquid tank for holding waste liquid that has been collected by the maintenance device, whereby the waste liquid tank is disposed adjacent to the maintenance device.

2. Description of the Related Art

There is known an inkjet recording apparatus which is an image forming apparatus such as a printer, a fax machine, a copier, and a multifunction peripheral including printer/fax/copier functions. In the inkjet recording apparatus, a recording head, which is (image forming unit) constituted by a liquid droplet jetting head for jetting liquid droplets of recording liquid, is used for forming images (recording and printing are also used as synonyms) by causing liquid droplets (hereinafter, also referred to as ink droplets) of recording ink to adhere onto a sheet while conveying the sheet.

There are various types of liquid droplet jetting heads, such as a piezo type, a thermal type, and an electrostatic type. The piezo type uses an electromagnetic transducer element such as a piezoelectric element. The thermal type uses an electrothermal element such as a heat element provided in the jetting head for jetting ink droplets by generating bubbles due to film boiling. The electrostatic type uses an electrostatic force to deform oscillating plates which form walls of a jetting chamber for jetting ink droplets.

In an inkjet recording apparatus, ink droplets are jetted from fine jetting outlets. Therefore, the jetting outlets may become clogged when the ink dries and the viscosity of the ink increases or the ink solidifies, or when bubbles are generated in the ink. As a result, jetting failures may occur. In order to prevent such jetting failures, there is provided a maintenance device for maintaining the ink jetting function in a normal state and restoring the ink jetting function.

For example, such a maintenance device includes the following mechanisms. One mechanism is for restoring the jetting outlet by filling the recording head with ink with the use of a pressurizing unit, in the event that a jetting failure occurs due to bubbles that have been generated in the jetting outlet during a recording operation. Another mechanism is for performing preliminary jetting (idle jetting) in preparation for when the viscosity of the ink increases or the ink solidifies due to natural evaporation of the ink in the jetting outlets. Yet another mechanism is for wiping off ink droplets and dust that have adhered to the surface of the jetting outlets. Two or more of these mechanisms may be combined.

Patent document 1 describes an apparatus in which an outer cover is detachably attached to the backside of the apparatus main body. On the inside of the outer cover, a waste liquid tank for holding waste liquid received from a maintenance/recovery mechanism, is detachably attached to the apparatus main body. The outer cover can be removed to retrieve the waste liquid tank, and provide a new waste liquid tank or reuse the same waste liquid tank. In conjunction with the waste liquid tank and the maintenance device being retrieved from the apparatus main body, the waste liquid tube part is blocked with a shutter mechanism.

Patent document 2 describes a liquid ejecting device including a liquid ejecting head for ejecting liquid; a cleaning unit for cleaning the liquid ejecting head by ejecting liquid from the liquid ejecting head through a liquid path; and a detachably attached liquid storing unit for storing the liquid ejected by the cleaning unit, whereby the liquid storing unit is disposed on the outlet side of the liquid path. The liquid storing unit includes an absorbing unit for absorbing the liquid, and a forced dropping unit for forcibly dropping the liquid remaining in the liquid path to a liquid receiving position of the absorbing unit when the liquid storing unit is detached from the liquid ejecting device.

Patent Document 1: Japanese Laid-Open Patent Application No. 2005-254636

Patent Document 2: Japanese Laid-Open Patent Application No. 2007-130998

However, in the apparatus described in patent document 1, the ink cannot be prevented from scattering while the image forming apparatus is operating.

In the device described in patent document 2, the ink cannot be prevented from scattering while the image forming apparatus is operating, and moreover, when the maintenance unit is retrieved from the image forming apparatus, ink cannot be prevented from spilling out of the maintenance device.

BRIEF SUMMARY

In a aspect of this disclosure, there is provided an image forming apparatus including a simple mechanism with which waste liquid is prevented from scattering out of a waste liquid jetting tube part of a maintenance device, and ink is prevented from spilling out of a maintenance device when the maintenance device is retrieved.

According to another aspect, there is provided an image forming apparatus including a recording head configured to jet liquid droplets of recording liquid; a maintenance device configured to maintain/restore a condition of the recording head, whereby the maintenance device is detachably attached to an apparatus main body of the image forming apparatus; and a waste liquid tank configured to hold waste liquid collected by the maintenance device, whereby the waste liquid tank is disposed adjacent to the maintenance device, wherein the maintenance device includes a waste liquid jetting tube configured to discharge the waste liquid into the waste liquid tank; the waste liquid tank includes an induction opening substantially surrounding the waste liquid jetting tube, whereby the induction opening includes a notch part through which the waste liquid jetting tube passes when the maintenance device is detached from the apparatus main body; and the image forming apparatus further includes a wall member configured to block at least part of the notch part when the maintenance device is attached in the apparatus main body.

According to another aspect, there is provided an image forming apparatus including a recording head configured to jet liquid droplets of recording liquid; a maintenance device configured to maintain/restore a condition of the recording head, whereby the maintenance device is detachably attached to an apparatus main body of the image forming apparatus; and a waste liquid tank configured to hold waste liquid collected by the maintenance device, Whereby the waste liquid tank is disposed adjacent to the maintenance device, wherein the maintenance device includes a waste liquid jetting tube configured to discharge the waste liquid into the waste liquid tank; the waste liquid tank includes an induction opening substantially surrounding the waste liquid jetting tube; and at least part of the induction opening is formed with an elastic member configured to deform as the waste liquid jetting tube of the maintenance device contacts the elastic member, so that the waste liquid jetting tube can pass through the induction opening.

According to an exemplary embodiment, an image forming apparatus is provided, which includes a wall member that blocks at least part of a notch part of an induction opening of a waste liquid tank when a maintenance device is attached to the main body of the image forming apparatus, so that waste liquid scattered from a waste liquid jetting tube part of the maintenance device is blocked by the wall member of the induction opening, thereby preventing waste liquid from scattering with a simple mechanism.

BRIEF DESCRIPTION OF THE DRAWINGS

The aforementioned and other aspects, features and advantages will become more apparent from the following detailed description when read in conjunction with the accompanying drawings, in which:

FIG. 3A is a schematic front view of the maintenance device and the waste liquid tank, and FIG. 3B is a perspective view of a duct part of the waste liquid tank;

DETAILED DESCRIPTION OF THE PREFERRED EMBODIMENTS

A description is given, with reference to the accompanying drawings, of embodiments of the present invention.

[Embodiments]

Figure 1:
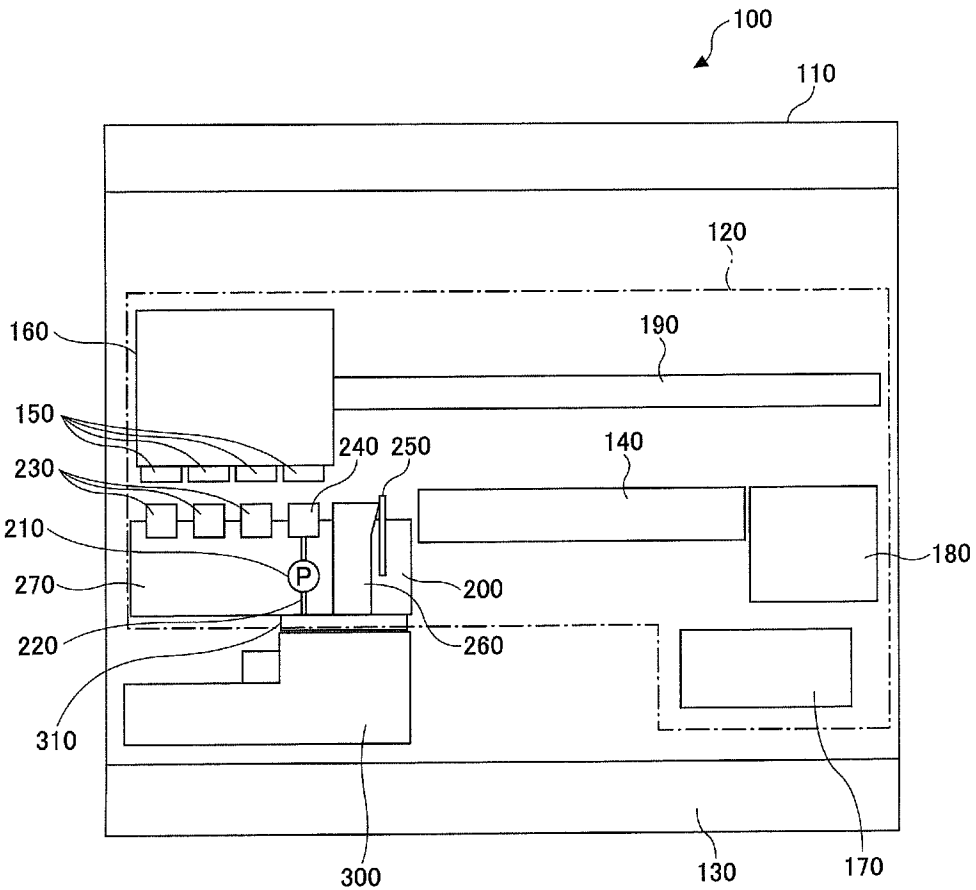
FIG. 1 is a schematic side view of an inkjet recording apparatus according to an embodiment of the present invention.

A description is given of an inkjet recording apparatus which is an image forming apparatus according to an embodiment of the present invention. FIG. 1 is a schematic side view of an inkjet recording apparatus according to an embodiment of the present invention. An inkjet recording apparatus 100 includes a recording device engine 120 for forming images, whereby the recording device engine 120 is provided inside an apparatus main body 110. A carriage 160 provided with recording heads 150 is provided in the recording device engine 120. The recording heads 150 are moved in a main scanning direction along a rod 190.

The inkjet recording apparatus 100 includes a sheet feeding unit 130 where recording media P is placed, whereby the sheet feeding unit 130 is located at the bottom of the apparatus main body 110. A recording medium that is fed out of the sheet feeding unit 130 is conveyed in a sub scanning direction by a belt 140 which is a sub scanning conveying unit.

The recording medium is then moved in a main scanning direction by the belt 140 while ink is jetted from the recording heads 150 of the carriage 160 that is driven in a main scanning direction, so that an image is formed on the recording medium.

The recording device engine 120 includes an ink cartridge 170, an ink collecting container 180, and a maintenance device 200. When the ink cannot be normally jetted from the recording heads 150, the maintenance device 200 performs a function recovery process on the recording heads 150 by suctioning the ink from the recording heads 150 through a auctioning cap 240 with the use of a pump 210. The auctioned waste liquid is provided through a waste liquid jetting tube part 220 that extends down from the bottom of a main unit 270 of a maintenance device 200, and into a waste liquid tank 300 having an induction opening 310. The maintenance device 200 includes moisture caps 230 for preventing the recording heads 150 from drying, a wiper blade 250 for cleaning the jetting outlets of the recording heads 150, and an ink collecting opening 260 for collecting the ink that has been removed by the wiper blade 250.

Figure 2:
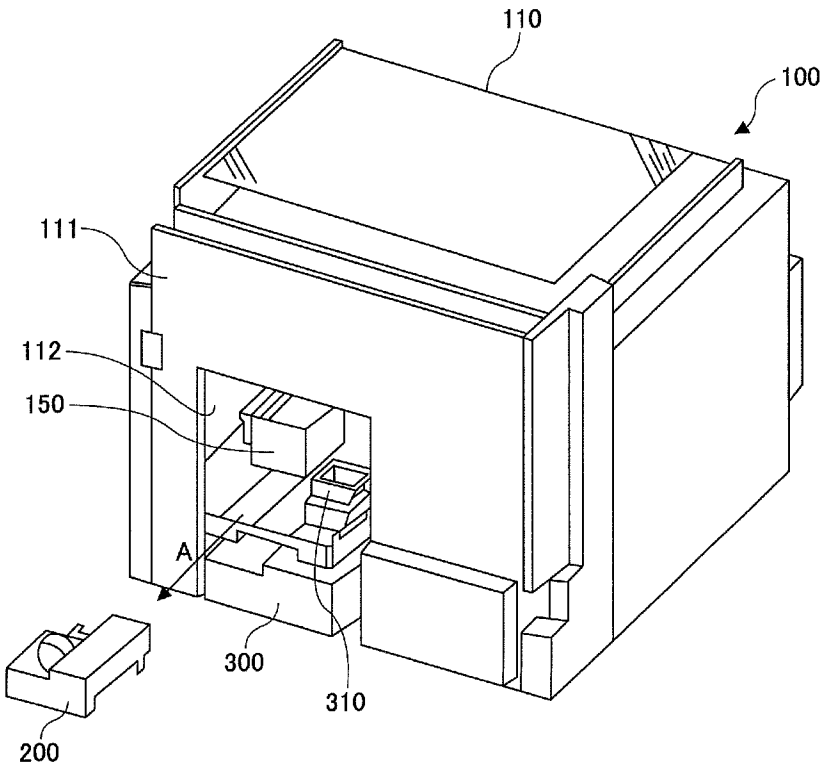
FIG. 2 is a perspective view of a state where a maintenance device is detached from the main body of the image forming apparatus.

Next, a description is given of the location of the maintenance device 200 in the inkjet recording apparatus 100. FIG. 2 is a perspective view of a state where the maintenance device 200 is detached from the main unit of the image forming apparatus. The maintenance device 200 is for receiving ink that is suctioned from the recording heads 150, and ink that is not used for printing but jetted for the purpose of maintaining the conditions of the recording heads 150 (idle jetting). This ink solidifies and deposits in the maintenance device 200. Accordingly, the operating life of the maintenance device 200 is typically set to be shorter than that of the apparatus main body 110. Thus, the maintenance device 200 is configured to be easily retrieved (detached) from the apparatus main body 110. Specifically, the maintenance device 200 can be retrieved by sliding out the maintenance device 200 through an opening part 112 provided on a side surface part 111 of the apparatus main body 110.

Figure 3A:
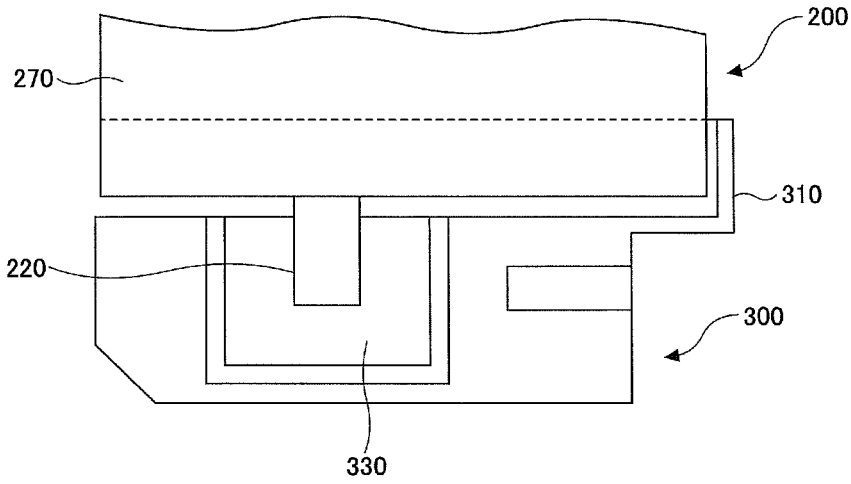
FIGS. 3A and 3B illustrate the maintenance device and a waste liquid tank, where
Figure 3B:
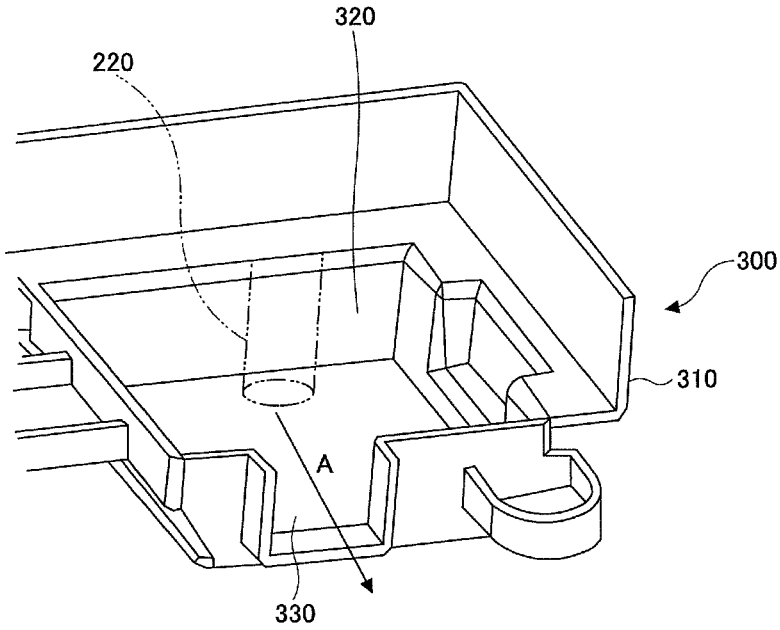

FIGS. 3A and 3B illustrate the maintenance device 200 and the waste liquid tank 300. FIG. 3A is a schematic front view of the maintenance device 200 and the waste liquid tank 300. FIG. 3B is a perspective view of a duct part of the waste liquid tank 300.

In the present embodiment, the maintenance device 200 is detachably attached to the apparatus main body 110 of the image forming apparatus, so that the maintenance device 200 can be retrieved by sliding it out. The waste liquid jetting tube part 220 extends down from the bottom of the maintenance device 200. The waste liquid tank 300 is positioned beneath the maintenance device 200 of the apparatus main body 110, and the induction opening 310 is positioned at the top part of the waste liquid tank 300 so as to surround the waste liquid jetting tube part 220. The waste liquid from the waste liquid jetting tube part 220 of the maintenance device 200 is discharged through the induction opening 310 and transferred into the waste liquid tank 300. The induction opening 310 has a peripheral wall part 320 substantially surrounding the waste liquid jetting tube part 220. In the present embodiment, in one side of the peripheral wall part 320, there is formed a notch part 330 through which the waste liquid jetting tube part 220 can pass when sliding the waste liquid jetting tube part 220 along a direction indicated by an arrow A (see FIGS. 2 and 3B) to retrieve the maintenance device 200 from the apparatus main body 110.

Figure 4A:
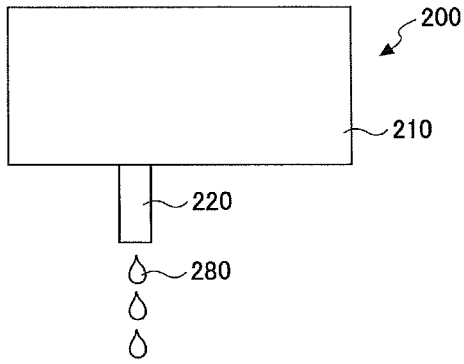
FIGS. 4A through 4C schematically illustrate a failure of the image forming apparatus.
Figure 4B:
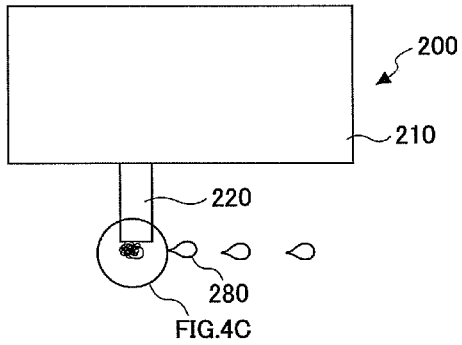
Figure 4C:
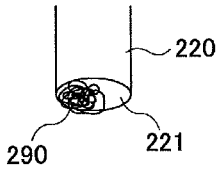

Merely forming the notch part 330 in the image forming apparatus may not be sufficient for preventing the following failure. FIGS. 4A through 4C schematically illustrate a failure of the image forming apparatus. FIG. 4C is a perspective magnified view of the circled part in FIG. 4B. When there is no ink adhering to the end of the waste liquid jetting tube part 220, as shown in FIG. 4A, ink 280 that is discharged from the waste liquid jetting tube part 220 drops straight down and enters the waste liquid tank 300 through the induction opening 310. However, when there is solid ink 290 adhering to the end of the waste liquid jetting tube part 220 (FIG. 4C), an end opening 221 of the waste liquid jetting tube part 220 is blocked by the solid ink 290. Accordingly, the end opening 221 of the waste liquid jetting tube part 220 may become very small, and may be directed sideways. When the end opening 221 reaches the notch part 330 that is cut out in the peripheral wall part 320 shown in FIGS. 3A and 3B, the ink 280 may scatter out from the notch part 330 and soil the inside of the image forming apparatus.

Furthermore, the waste liquid may not be completely removed, and may still be remaining in the waste liquid jetting tube part 220 of the maintenance device 200. Due to the impact when the maintenance device 200 is retrieved from the image forming apparatus in such a condition, the ink remaining in the waste liquid jetting tube part 220 may drop. Thus, the inside or the image forming apparatus or the floor on which the image forming apparatus is placed may be soiled.

Figure 5A:
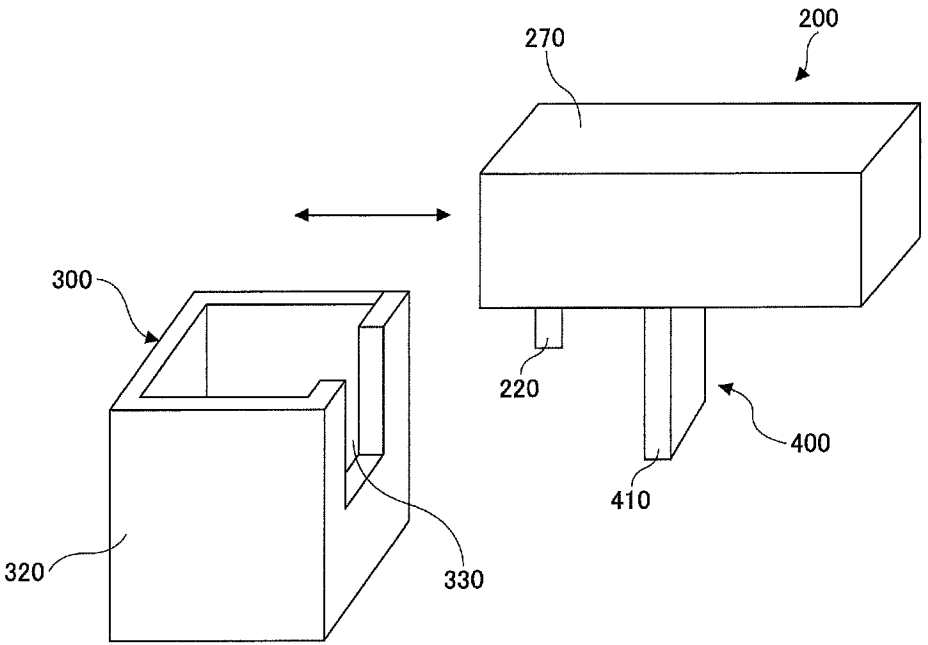
FIGS. 5A and 5B illustrate a liquid droplet jetting device according to a first embodiment, where FIG. 5A schematically illustrates the state where the maintenance device is detached from the inkjet recording apparatus, and FIG. 5B schematically illustrates the state where the maintenance device is attached to the inkjet recording apparatus.
Figure 5B:
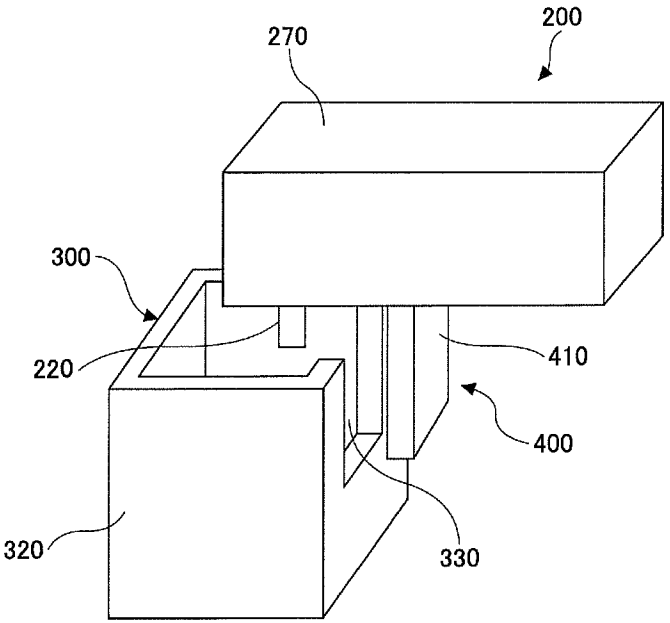
Figure 6:
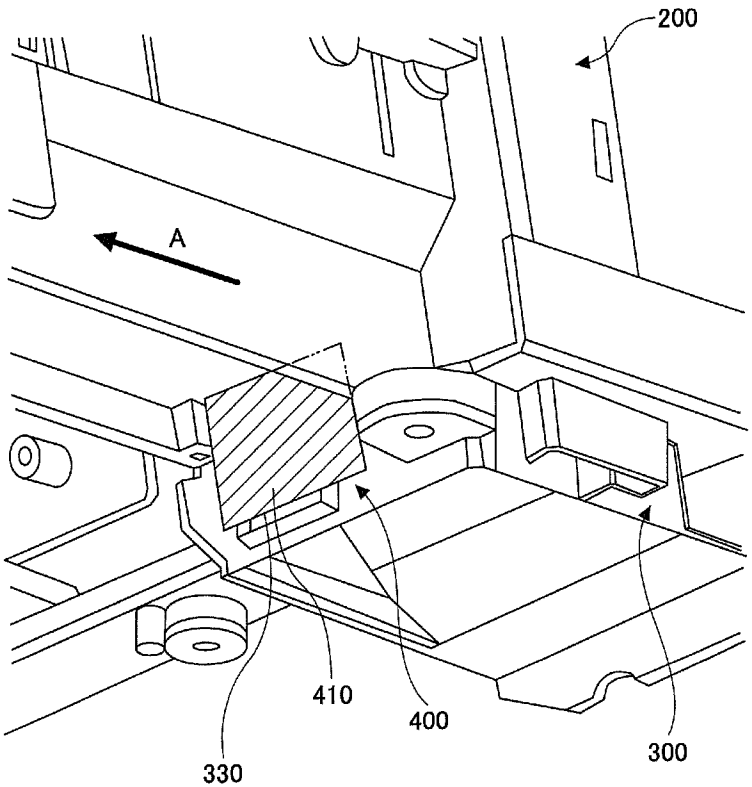
FIG. 6 is a perspective view of the liquid droplet jetting device according to the first embodiment.

Accordingly, in the present embodiment, a wall member covering the notch part 330 of the waste liquid tank 300 is provided in the maintenance device 200. The wall member may have various configurations. First, a description is given of a liquid droplet jetting device according to a first embodiment. FIGS. 5A and 5B illustrate a liquid droplet jetting device according to the first embodiment. FIG. 5A schematically illustrates the state where the maintenance device 200 is detached from the inkjet recording apparatus 100, FIG. 5B schematically illustrates the state where the maintenance device 200 is attached to the inkjet recording apparatus 100, and FIG. 6 is a perspective view of the liquid droplet jetting device according to the present embodiment. In the present embodiment, as shown in FIG. 5A, a wall member 400 is provided in the maintenance device 200. The wall member 400 has a plate 410 made of Mylar (registered trademark) extending down from the main unit 270 of the maintenance device 200. In the present embodiment, when the maintenance device 200 is set into the apparatus main body 110 of the inkjet recording apparatus 100, the plate 410 of the wall member 400 contacts the periphery of the notch part 330 formed in the peripheral wall part 320 of the waste liquid tank 300 so as to cover the notch part 330, as shown in FIG. 5B and FIG. 6. Accordingly, in the liquid droplet jetting device according to the present embodiment, when the maintenance device 200 is attached to the inkjet recording apparatus 100, the plate 410 covers the notch part 330 of the peripheral wall part 320, so that waste liquid (ink) scattering from the waste liquid jetting tube part 220 is prevented from scattering outside from the waste liquid tank 300.

Figure 7A:
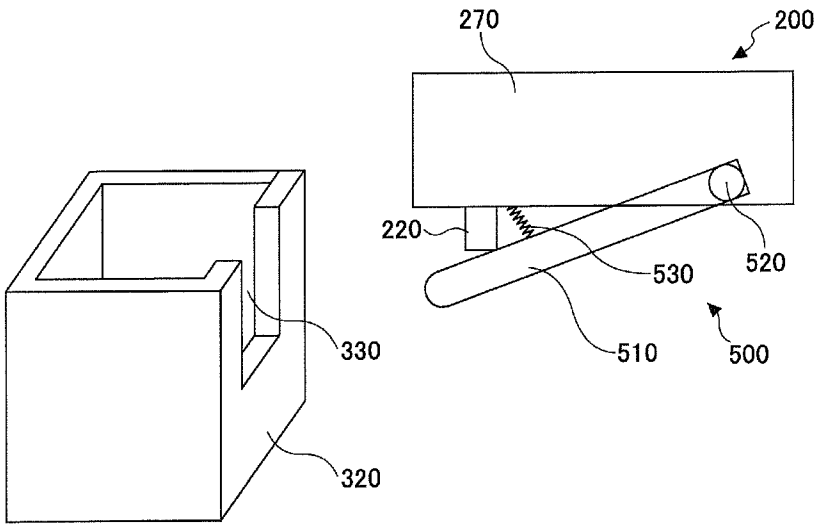
FIGS. 7A and 7B illustrate a liquid droplet jetting device according to a second embodiment, where FIG. 7A schematically illustrates the state where the maintenance device is detached from the inkjet recording apparatus, and FIG. 7B schematically illustrates the state where the maintenance device is attached to the inkjet recording apparatus.
Figure 7B:
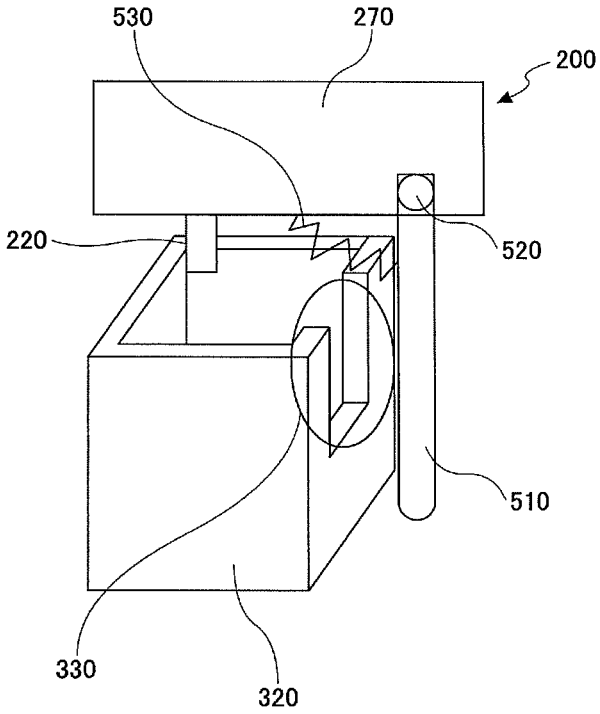

Next, a description is given of a modification of the liquid droplet jetting device according to a second embodiment. FIGS. 7A and 7B illustrate the liquid droplet jetting device according to the second embodiment. FIG. 7A schematically illustrates the state where the maintenance device 200 is detached from the inkjet recording apparatus 100, and FIG. 7B schematically illustrates the state where the maintenance device 200 is attached to the inkjet recording apparatus 100. In a wall member 500, a plate 510 is provided in such a manner as to pivot on a shaft 520. In between the plate 510 and the main unit 270 of the maintenance device 200, an extension coil spring 530 is provided so that the plate 510 is urged against the main unit 270. In such a configuration, when the maintenance device 200 is not attached to the apparatus main body 110, as shown in FIG. 7A, the plate 510 is positioned beneath the waste liquid jetting tube part 220 due to the extension coil spring 530, so as to block waste liquid dropping from the waste liquid jetting tube part 220. Meanwhile, when the maintenance device 200 is attached to the inkjet recording apparatus 100, as shown in FIG. 7B, the plate 510 contacts the induction opening 310 of the waste liquid tank 300 and pivots, so as to cover the notch part 330 of the peripheral wall part 320. Accordingly, the waste liquid (ink) scattering from the waste liquid jetting tube part 220 is prevented from scattering out from the notch part 330.

According to the present embodiment, the maintenance device 200 is provided with the wall member 500. Therefore, while the maintenance device 200 is attached to the inkjet recording apparatus 100, it is possible to prevent soiling caused by the waste liquid scattering from the waste liquid jetting tube part 220. Meanwhile, when the maintenance device 200 is detached from the inkjet recording apparatus 100, the ink dropping from the moisture caps 230 of the maintenance device 200 can be blocked, so that the image forming apparatus is prevented from being soiled due to dropping ink.

Figure 8:
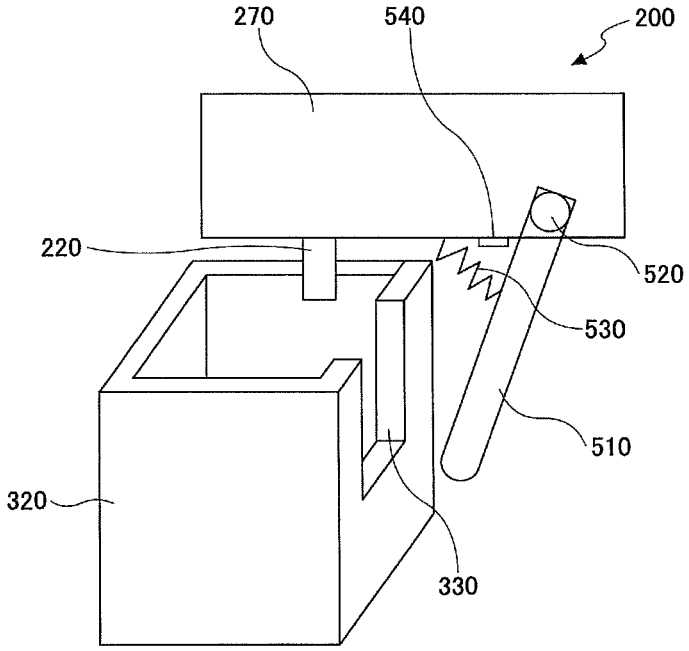
FIG. 8 schematically illustrates a liquid droplet jetting device according to a modification of the second embodiment.

Next, a description is given of a modification of the second embodiment. FIG. 8 schematically illustrates a liquid droplet jetting device according to the modification of the second embodiment. In the present embodiment, the main unit 270 of the maintenance device 200 is provided with a damper device 540 for absorbing the impact caused when the plate 510 contacts the main unit 270 of the maintenance device 200. The damper device 540 is, for example, a rubber member, which is disposed on the bottom side of the main unit 270. Specifically, the damper device 540 is located on the bottom side of the main unit 270, where the plate 510 contacts the main unit 270 upon pivoting along a trajectory by being urged by the extension coil spring 530. According to the present embodiment, when the maintenance device 200 is retrieved from the apparatus main body 110 of the inkjet recording apparatus 100, the waste liquid adhering to the plate 510 is prevented from scattering around when the plate 510 impacts the maintenance device 200.

Figure 9:
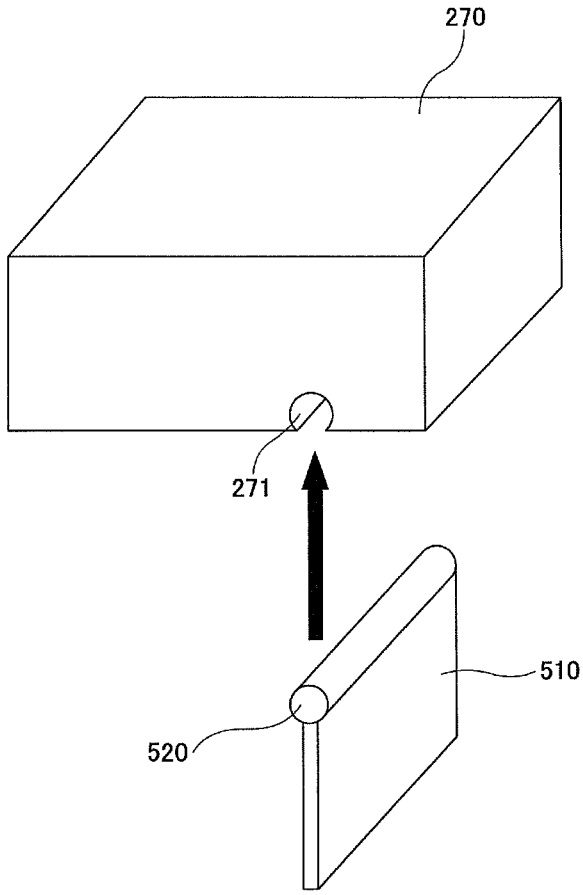
FIG. 9 schematically illustrates a liquid droplet jetting device according to another modification of the second embodiment.

Next, a description is given of another modification of the second embodiment. FIG. 9 schematically illustrates a liquid droplet jetting device according to the other modification of the second embodiment. In the present embodiment, the plate 510 and the shaft 520 of the wall member 500 are combined as a single unit, which is detachably attached to a hole part 271 formed in the main unit 270 of the maintenance device 200. The main unit 270 of the maintenance device 200 is made of synthetic resin that is elastically deformable. The hole part 271 is made by forming an opening on the bottom side of the main unit 270.

Figure 10A:
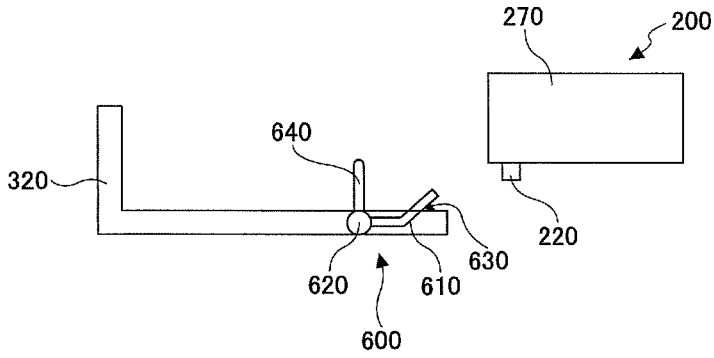
FIGS. 10A and 10B illustrate a liquid droplet jetting device according to a third embodiment, where FIG. 11A schematically illustrates the state of the maintenance device detached from the inkjet recording apparatus, and FIG. 10B schematically illustrates the state of the maintenance device attached to the inkjet recording apparatus.
Figure 10B:
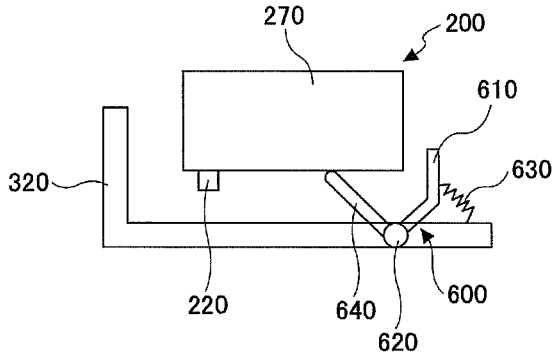

Next, a description is given of a third embodiment. FIGS. 10A and 10B illustrate a liquid droplet jetting device according to the third embodiment. FIG. 10A schematically illustrates the state of the maintenance device 200 detached from the inkjet recording apparatus 100, and FIG. 10B schematically illustrates the state of the maintenance device 200 attached to the inkjet recording apparatus 100. In the present embodiment, a wall member 600 is provided in the waste liquid tank 300 disposed in the apparatus main body 110 of the inkjet recording apparatus 100.

In the wall member 600 according to the present embodiment, a plate 610 is rotatably provided on a shaft 620 that is disposed in the waste liquid tank 300, and the plate 610 has a coil spring 630 and a contact plate 640. The coil spring 630 urges the plate 610 in the direction toward the outside of the notch part 330, and the contact plate 640 is fixed to the plate 610 such that a substantial right angle is formed between the contact plate 640 and the plate 610. When the waste liquid jetting tube part 220 of the maintenance device 200 contacts the contact plate 640, the plate 610 rotates to a position where it seals the notch part 330.

In the present embodiment, when the maintenance device 200 is attached to the apparatus main body 110 of the inkjet recording apparatus 100, as shown in FIG. 10B, the contact plate 640 is pressed by the pump 210, so that the plate 610 rises and covers the notch part 330 of the peripheral wall part 320.

According to the present embodiment, the maintenance device 200 is provided with the wall member 600. Therefore, while the maintenance device 200 is attached to the inkjet recording apparatus 100, it is possible to prevent soiling caused by the waste liquid scattering from the waste liquid jetting tube part 220.

Figure 11A:
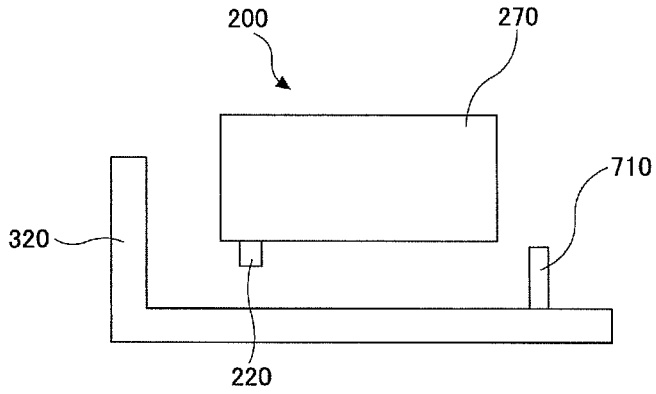
FIGS. 11A and 11B illustrate a liquid droplet jetting device according to a fourth embodiment, where FIG. 11A schematically illustrates the state of the maintenance device set inside the inkjet recording apparatus, and FIG. 11B schematically illustrates the state of the maintenance device being attached into the inkjet recording apparatus.
Figure 11B:
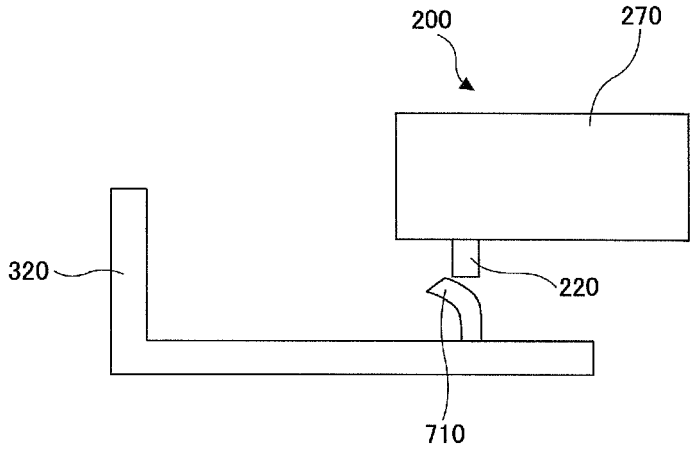

Next, a description is given of a fourth embodiment. FIGS. 11A and 11B illustrate a liquid droplet jetting device according to the fourth embodiment. FIG. 11A schematically illustrates the state of the maintenance device 200 set inside the inkjet recording apparatus 100, and FIG. 11B schematically illustrates the state of the maintenance device 200 being attached into the inkjet recording apparatus 100.

In the present embodiment, at a position corresponding to the notch part 330, the peripheral wall part 320 of the waste liquid tank 300 is provided with an elastic rubber plate member 710, in such a manner as to cover the notch part 330. In the present embodiment, when the maintenance device 200 is attached into the inkjet recording apparatus 100, as shown in FIG. 11B, the waste liquid jetting tube part 220 of the maintenance device 200 contacts the plate member 710, so that the plate member 710 elastically deforms. Accordingly, the maintenance device 200 can be easily attached in the inkjet recording apparatus 100. When the maintenance device 200 is set inside the inkjet recording apparatus 100, as shown in FIG. 11A, the plate member 710 returns to its original shape, so that the waste liquid scattering from the waste liquid jetting tube part 220 is prevented from scattering outside of the peripheral wall part 320.

Furthermore, when the maintenance device 200 is retrieved from the apparatus main body 110, the plate member 710 deforms in the direction opposite to that when the maintenance device 200 is attached, so that the maintenance device 200 can be easily retrieved from the inkjet recording apparatus 100.

Thus, according to the present embodiment, with a simple structure of providing a plate member to the waste liquid tank, the maintenance device can be easily attached/detached, and soiling caused by scattering waste liquid can be prevented.

The present invention is not limited to the specifically disclosed embodiment, and variations and modifications may be made without departing from the scope of the present invention.

The present application is based on Japanese Priority Patent Application No. 2008-193088, filed on Jul. 28, 2008, the entire contents of which are hereby incorporated herein by reference.

What is claimed is:

1. An image forming apparatus comprising:

a recording head configured to jet liquid droplets of recording liquid;

a maintenance device configured to maintain and restore a condition of the recording head, the maintenance device being detachably attached to an apparatus main body of the image forming apparatus; and a waste liquid tank configured to hold waste liquid collected by the maintenance device, the waste liquid tank being disposed adjacent to the maintenance device, wherein:

the maintenance device comprises a waste liquid jetting tube configured to discharge waste liquid into the waste liquid tank;

the waste liquid tank comprises an induction opening substantially surrounding the waste liquid jetting tube, a peripheral wall part that is substantially vertical, and a notch part formed as an opening in the substantially vertical peripheral wall part of the waste liquid tank, the waste liquid jetting tube passing through the opening of the notch part when the maintenance device is detached from the apparatus main body and caused to move in a substantially horizontal direction;

a top edge of a portion of the substantially vertical peripheral wall part in which the notch part is not formed is configured to be positioned higher, in a substantially vertical direction from a bottom edge of the peripheral wall part to the top edge, than a bottom edge of the waste liquid jetting tube, and a bottom edge of the notch part which is below the top edge of another portion of the peripheral wall part is configured to be positioned lower in the substantially vertical direction than the bottom edge of the waste liquid jetting tube;

the maintenance device further comprises a wall member disposed at a position, and having a size and a shape, to a periphery of the notch part when the maintenance device is attached in the apparatus main body;

the maintenance device is configured and disposed to he detached from, and attached to, the apparatus main body of the image forming apparatus by sliding he maintenance device in the substantially horizontal direction, and when the maintenance device is slid in the substantially horizontal direction to be attached to the image forming apparatus, the wall member contacts the periphery of the notch part formed in the peripheral wall part of the waste liquid tank so as to cover the notch part; and when the wall member contacts the periphery of the notch part to cove the notch part, the peripheral wall part of the waste liquid tank and the wall member of the maintenance device are complementary to each other to surround the waste liquid jetting tube.

2. The image forming apparatus according to claim 1, wherein:

when the maintenance device is attached to the apparatus main body, the wall member is positioned so as to cover at least part of the notch part of the waste liquid tank; and when the maintenance device is detached from the apparatus main body, the wall member is positioned so as to block a downward direction of the waste liquid jetting tube of the maintenance device.

3. The image forming apparatus according to claim 1, wherein:

the wall member is disposed on the apparatus main body, and is configured to cover at least part of the notch part of the waste liquid tank in conjunction with the maintenance device being attached to the apparatus main body.

4. The image forming apparatus according to claim 1, wherein:

a damper member is disposed on a movement path of the wall member, whereby the damper member is configured to absorb an impact caused when the wall member stops.

5. The image forming apparatus according to claim 1, wherein:

the wall member is detachably attached to the maintenance device.

6. The image forming apparatus according to claim 1, wherein the opening of the notch part is substantially rectangular in shape.

7. The image forming apparatus according to claim 1, wherein the notch part is cut out of a portion of the peripheral wall part of the waste liquid tank.

8. The image forming apparatus according to claim 1, wherein the maintenance device includes an ink collecting opening and a wiping member disposed to remove adhering ink from an outlet of the recording head, and the adhering ink removed from the outlet of the recording head is collected through the ink collecting opening into the waste liquid tank.

9. The image forming apparatus according to claim 1, wherein the maintenance device includes a pump and a capping member coupled to the pump to suction adhering ink from the recording head, and the adhering ink suctioned from the recording head is channeled through the waste liquid jetting tube into the waste liquid tank.

10. An image forming apparatus comprising:

an apparatus main body including a side wall part and an opening in said side wall part;

a recording head that jets liquid droplets of recording liquid;

a maintenance device that maintains and restores a condition of the recording head, the maintenance device being detachably attached to the apparatus main body of the image forming apparatus; and a waste liquid tank that holds waste liquid collected by the maintenance device, wherein:

the maintenance device comprises a waste liquid jetting tube that is disposed to discharge the waste liquid into the waste liquid tank;

the waste liquid tank comprises a peripheral wall part that is substantially vertical and is disposed to surround the waste liquid jetting tube when the maintenance device is attached to the apparatus main body, and a notch part formed as an opening in the substantially vertical peripheral wall part of the waste liquid tank;

a top edge of a portion of the substantially vertical peripheral wall part in which the notch part is not formed is configured to he positioned higher, in a substantially vertical direction from a bottom edge of the peripheral wall part to the top edge, than a bottom edge of the waste liquid jetting tube, and a bottom edge of the notch part which is below the top edge of another portion of the peripheral wall part is configured to be positioned lower in the substantially vertical direction than the bottom edge of the waste liquid jetting tube;

the maintenance device attached to the apparatus main body of the image forming apparatus is disposed to be retrieved from the image forming apparatus by detaching the maintenance device from the apparatus main body and sliding the maintenance device in a substantially horizontal direction through the opening in said side wall part of the apparatus main body, the waste liquid jetting tube passing through the opening of the notch part when the maintenance device, detached from the apparatus main body, is slid in the substantially horizontal direction;

the maintenance device includes a wall member disposed at a position, and having a size and a shape, to contact a periphery of the notch part when the maintenance device is attached in the apparatus main body;

the maintenance device is configured and disposed to be detached from, and attached to, the apparatus main body of the image forming apparatus by sliding the maintenance device in the substantially horizontal direction, and when the maintenance device is slid in the substantially horizontal direction to be attached to the image forming apparatus, the wall member contacts the periphery of the notch part formed in the peripheral wall part of the waste liquid tank so as to cover the notch part; and when the wall member contacts the periphery of the notch part to cover the notch part, the peripheral wall part of the waste liquid tank and the wall member of the maintenance device are complementary to each other to surround the waste liquid jetting tube.

11. The image forming apparatus according to claim 1, wherein the notch part is formed as a permanent and fixed opening in the substantially vertical peripheral wall part of the waste liquid tank.

12. The image forming apparatus according to claim 1, wherein when the waste liquid jetting tube passes through the opening of the notch part, the waste liquid jetting tube does not contact any portion of the waste liquid tank.

* * * * *